US007416279B2

(12) United States Patent
Isono

(10) Patent No.: US 7,416,279 B2
(45) Date of Patent: Aug. 26, 2008

(54) CONNECTION STRUCTURE FOR INKJET RECORDING HEAD

(75) Inventor: Jun Isono, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 322 days.

(21) Appl. No.: 11/040,744

(22) Filed: Jan. 21, 2005

(65) Prior Publication Data

US 2005/0162484 A1 Jul. 28, 2005

(30) Foreign Application Priority Data

Jan. 23, 2004 (JP) ..... 2004-015494

(51) Int. Cl.
*B41J 2/045* (2006.01)

(52) U.S. Cl. ..... 347/50; 347/68; 347/69; 347/70; 347/71; 347/72

(58) Field of Classification Search ..... 347/50, 347/68–72, 40, 58–59; 310/323.06; 257/688–690
See application file for complete search history.

(56) References Cited

U.S. PATENT DOCUMENTS 5,315,472 A * 5/1994 Fong et al. ..... 361/212
5,539,436 A * 7/1996 Wilson et al. ..... 347/37
5,644,341 A * 7/1997 Fujii et al. ..... 347/11
5,818,473 A * 10/1998 Fujii et al. ..... 347/11
5,821,951 A * 10/1998 Fujii et al. ..... 347/10
5,912,684 A * 6/1999 Fujii et al. ..... 347/54
6,003,974 A * 12/1999 Wilson et al. ..... 347/50
6,007,185 A * 12/1999 Hirosawa et al. ..... 347/50
6,036,302 A * 3/2000 Hotomi ..... 347/55
6,062,675 A * 5/2000 Hirosawa et al. ..... 347/50
6,142,614 A * 11/2000 Hashizume et al. ..... 347/70
6,332,669 B1 * 12/2001 Kato et al. ..... 347/54
6,454,394 B2 * 9/2002 Shibano et al. ..... 347/49
6,530,637 B2 * 3/2003 Sawano ..... 347/15
6,595,628 B2 7/2003 Takagi et al.
7,055,936 B2 * 6/2006 Imai et al. ..... 347/58
2002/0113847 A1 * 8/2002 Takagi et al. ..... 347/72
2003/0063449 A1 4/2003 Suzuki et al.

(Continued)

FOREIGN PATENT DOCUMENTS

JP 11-147311 6/1999

(Continued)

*Primary Examiner*—Manish S. Shah
*Assistant Examiner*—Mark J Stevenosky, Jr.
(74) *Attorney, Agent, or Firm*—Reed Smith LLP

(57) ABSTRACT

A structure for connecting an inkjet recording head, including an actuator on which connecting terminals are disposed to apply therethrough drive voltage to respective channels formed in the head for ejecting an ink droplet onto a recording medium, to a circuit element through which control signals for controlling an operation of the head are supplied, is disclosed. The circuit element is disposed on a wiring board having bump electrodes formed thereon. The connecting terminals are superposed on and connected to the bump electrodes. Each connecting terminal comprises a surface electrode having a small thickness, and an external electrode having a large thickness and formed on the surface electrode. A part of the surface electrode has a width larger than that of the other part, and the external electrode is disposed such that a margin thereof is positioned on an inside of a periphery of the wide part.

8 Claims, 9 Drawing Sheets

U.S. PATENT DOCUMENTS

| | | | | |
|---|---|---|---|---|
| 2003/0081065 | A1* | 5/2003 | Zhang et al. | 347/50 |
| 2003/0103115 | A1* | 6/2003 | Watanabe et al. | 347/68 |
| 2003/0103117 | A1* | 6/2003 | Sakuma | 347/71 |
| 2003/0103118 | A1* | 6/2003 | Watanabe et al. | 347/71 |
| 2003/0107622 | A1* | 6/2003 | Sugahara | 347/71 |

FOREIGN PATENT DOCUMENTS

| | | |
|---|---|---|
| JP | A-2002-254657 | 9/2002 |
| JP | A-2003-159795 | 6/2003 |

* cited by examiner

CONNECTION STRUCTURE FOR INKJET RECORDING HEAD

The present application is based on Japanese Patent Application No. 2004-015494 filed on Jan. 23, 2004, the contents of which are incorporated herein by reference.

BACKGROUND OF THE INVENTION

1. Field of the Invention

The present invention relates to a connection structure of an inkjet recording head, and particularly to a structure of a connecting terminal which is formed on a surface of an actuator of an inkjet recording head to be connected to a wiring board from which electric power is supplied.

2. Discussion of Related Art

There is disclosed in JP-A-2003-159795 corresponding to U.S. Patent Application Publication No. 2003/063449 A1, for instance, an inkjet recording head of drop-on-demand type constructed such that a cavity unit constituted by a laminar structure consisting of plural plates is connected to a piezoelectric actuator which has two rows of pressure chambers formed inside, and activation portions (energy generators) corresponding to the respective pressure chambers. To enable to apply voltage to the activation portions, surface electrodes as connecting terminals corresponding to the respective activation portions are formed on an upper surface of the piezoelectric actuator along two margins extending in a longitudinal direction of the upper surface, and connecting electrodes of a flexible flat cable which is provided to transmit control signals from an external device are superposed on, and connected to, the surface electrodes (connecting terminals) of the piezoelectric actuator.

It has been proposed, as disclosed in JP-A-11-147311, that the flexible flat cable be constituted by a laminar structure of substrates respectively having wiring on one of their opposite surfaces, and openings be formed through at least one of the substrates so that wiring on another substrate disposed on the at least one substrate is exposed to the outer space through the openings, at each of which a bump electrode (as a connecting electrode) is formed to be connected to a corresponding one of the surface electrodes on the piezoelectric actuator.

Such bump electrodes are generally formed of a solder alloy, which is softened or melted by application of heat.

On the other hand, the piezoelectric actuator is generally formed by laminating three green sheets of ceramic material, namely, a first green sheet, a second green sheet, and a third green sheet as a top plate, and then firing the laminate. The first green sheet is made of a ceramic material as a piezoelectric material on which a pattern of individual electrodes is formed. The second green sheet is similar to the first green sheet but a pattern of 'common' electrodes is formed thereon instead of the individual electrodes, and the green sheet as the top plate is similar to the first and second green sheets and has surface electrodes formed thereon. The individual and common electrodes and the surface electrodes, which are electrically connected to the individual and common electrodes, are formed on the respective green sheets by screen printing with an Ag—Pd (silver-palladium)-based paste which is electrically conductive.

Although such a kind of the surface electrodes electrically connected to the individual and common electrodes is excellent in its wettability with a solder alloy, it suffers from low bonding strength with an upper surface of the piezoelectric actuator due to a small thickness of the surface electrodes, leading to the following drawback.

Since the flexible flat cable generally comprises a flexible substrate of a synthetic resin, a degree of its thermal expansion/contraction is relatively large. Therefore when the flexible flat cable is repeatedly used for a long term under conditions where the temperature of the flexible flat cable varies greatly, the distance between each adjacent two of the bump electrodes of the flexible flat cable increases and decreases, leading to peel-off of the surface electrodes as connected to the bump electrodes from the upper surface of the piezoelectric actuator, at a part where the bonding strength is relatively low. Thus, electric disconnection often occurs.

To solve this drawback, the present applicant has proposed to form eternal electrodes on respective surface electrodes.

It was revealed that the bonding strength between the solder alloy or the bump electrodes and the external electrodes can be enhanced by this arrangement. However, the problem of occurrence of electric disconnections has not been solved by this arrangement, since a fillet, which is formed such that when a molten solder alloy flows from a surface of the external electrode over a surface of the surface electrode and is solidified there, cracks upon expansion and contraction (especially, contraction) of the flexible flat cable caused by the variation or change in the temperature of the flexible flat cable.

SUMMARY OF THE INVENTION

An object of the present invention is to solve the above-described problem.

To attain this object, the invention provides a connection structure for connecting an inkjet recording head which includes an actuator on which a plurality of connecting terminals to apply therethrough a drive voltage to each of a plurality of channels formed in the inkjet recording head for ejection of an ink droplet onto a recording medium, to a circuit element through which control signals for controlling an operation of the inkjet recording head are supplied. The circuit element is disposed on a wiring board having a plurality of bump electrodes formed thereon, and the connecting terminals are superposed on and connected to the bump electrodes. Each of the connecting terminals comprises a surface electrode having a relatively small thickness, and an external electrode having a relatively large thickness and formed on the surface electrode. At least a part of the surface electrode has a width larger than the other part thereof to constitute a wide part of the surface electrode, and the external electrode is disposed such that a margin of the external electrode is positioned on an inner side of a periphery of the wide part.

According to the arrangement where at least a part of the surface electrode of each of the connecting terminals formed separately from one another in a configuration like islets constitutes a wide part, and the external electrode is disposed such that its margin is located inside the periphery of the surface electrode, it is ensured that a fillet of a solder alloy forming each of the bump electrodes by being melted and then solidified is formed with a relatively large thickness, between the margin of the external electrode and a surface of the wide part on the inner side of the periphery of the surface electrode. Thus, the connecting terminals on the actuator and the bump electrodes on the wiring board are connected to each other with high reliability, with an enhanced bonding strength. Therefore, even when the wiring board expands and contracts in a direction in which the bump electrodes are aligned, due to variation in the temperature of the flexible flat cable or other reasons, the bump electrodes do not come off the connecting terminals and the connection therebetween is maintained. Thus occurrence of an electric disconnection is prevented and the reliability of a product employing this connection structure is improved.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

There will be described one embodiment of the invention with reference to the accompanying drawings.

Figure 1:
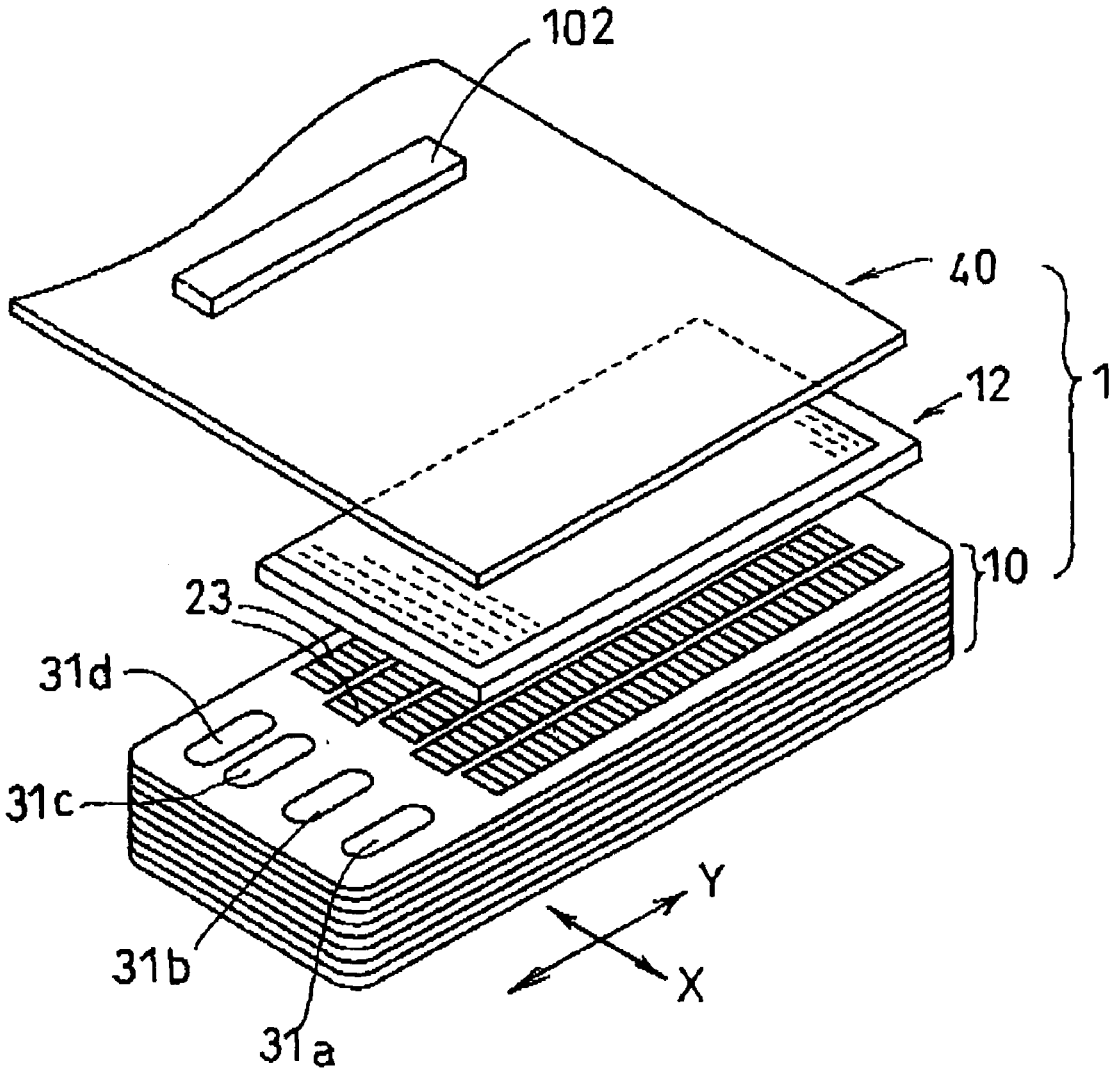
FIG. 1 is a perspective view showing in separation a cavity unit, a piezoelectric actuator, and a flat cable of a piezoelectric inkjet recording head according to a first embodiment of the invention.
Figure 2:
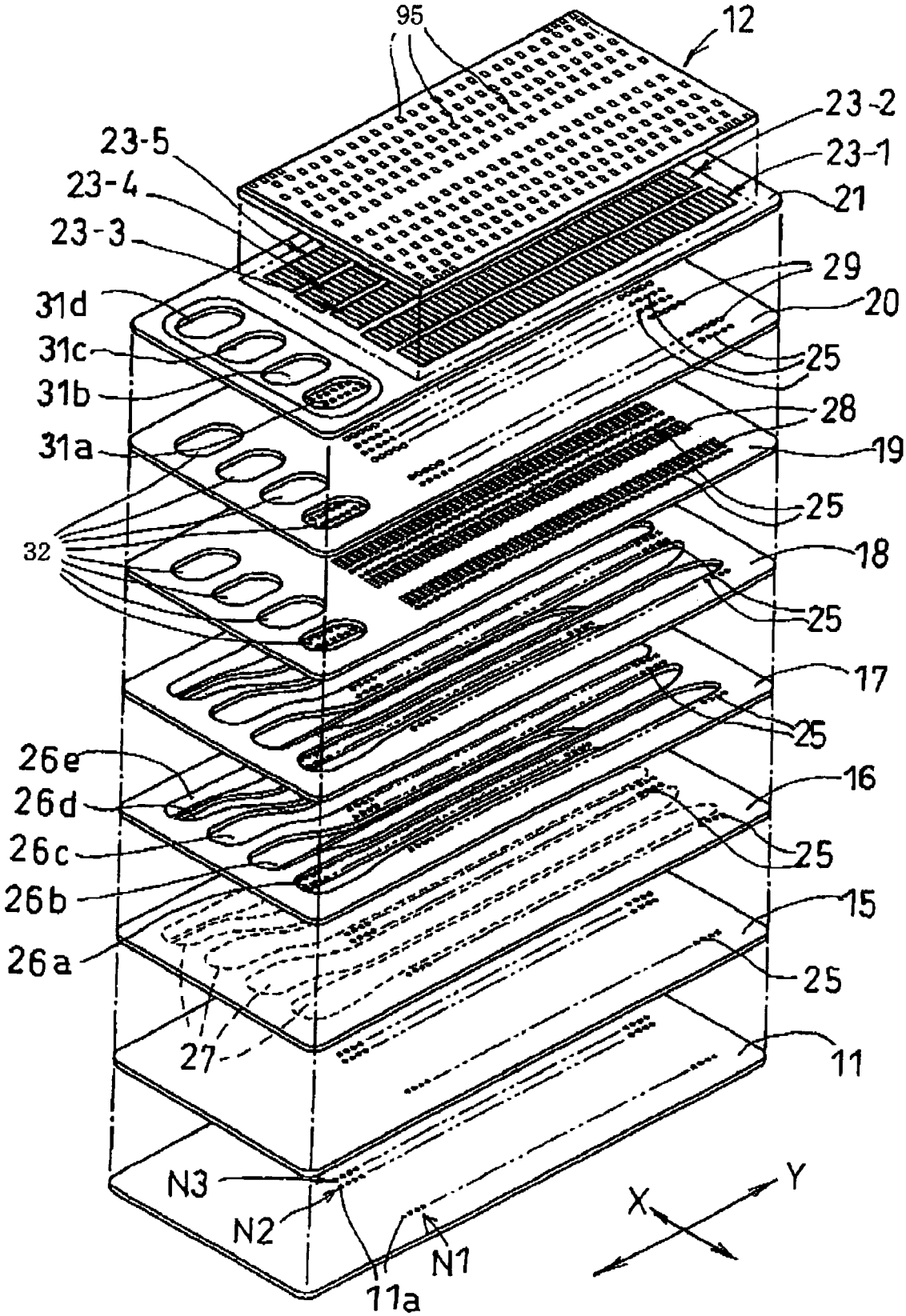
FIG. 2 is an exploded perspective view of the cavity unit.
Figure 3:
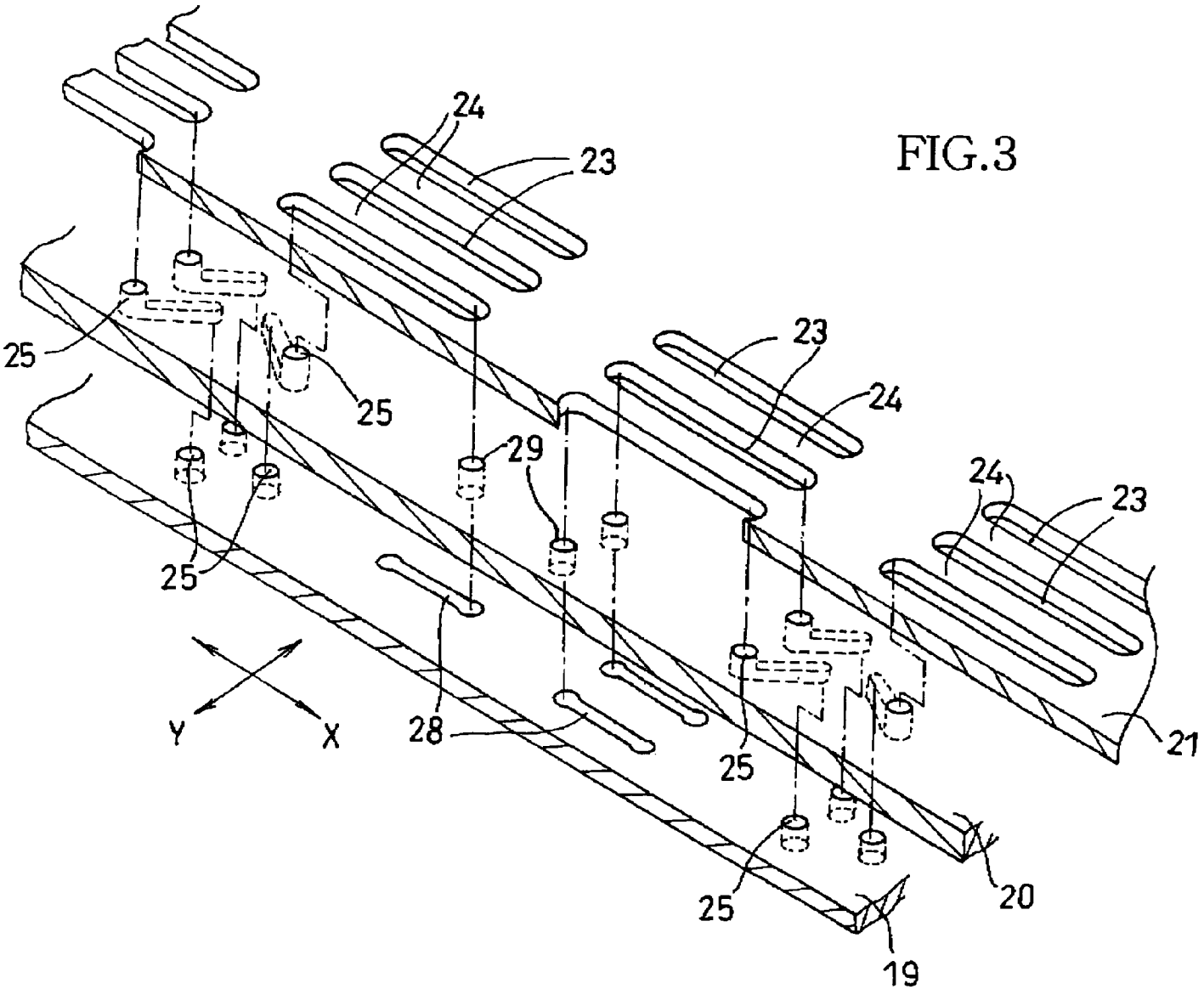
FIG. 3 is an exploded perspective view of a part of the cavity unit.
Figure 4:
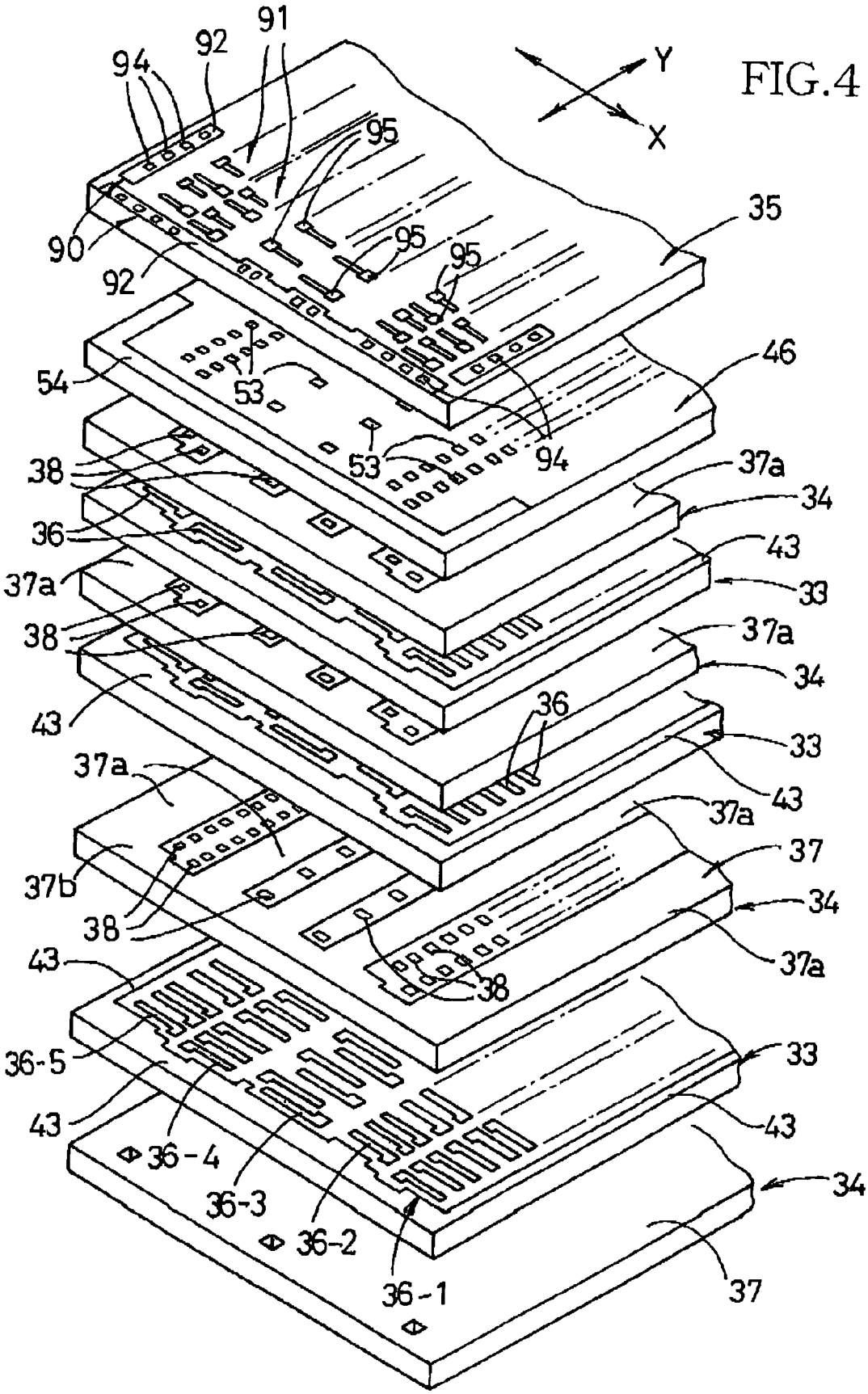
FIG. 4 is an exploded perspective view of a part of the piezoelectric actuator.
Figure 5:
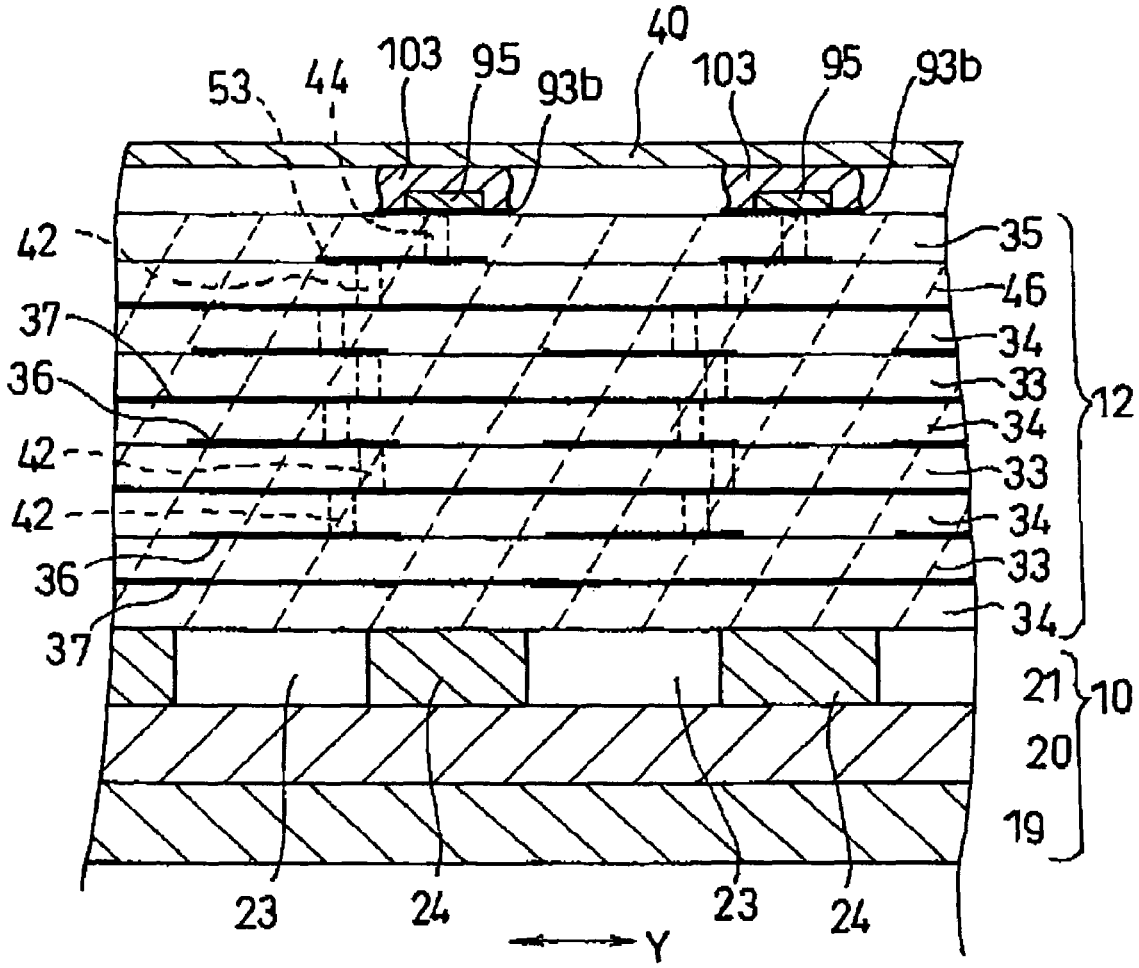
FIG. 5 is an enlarged sectional view showing individual electrodes and common electrodes on piezoelectric sheets, and internal conduction electrodes electrically connecting the individual and common electrodes.
Figure 6:
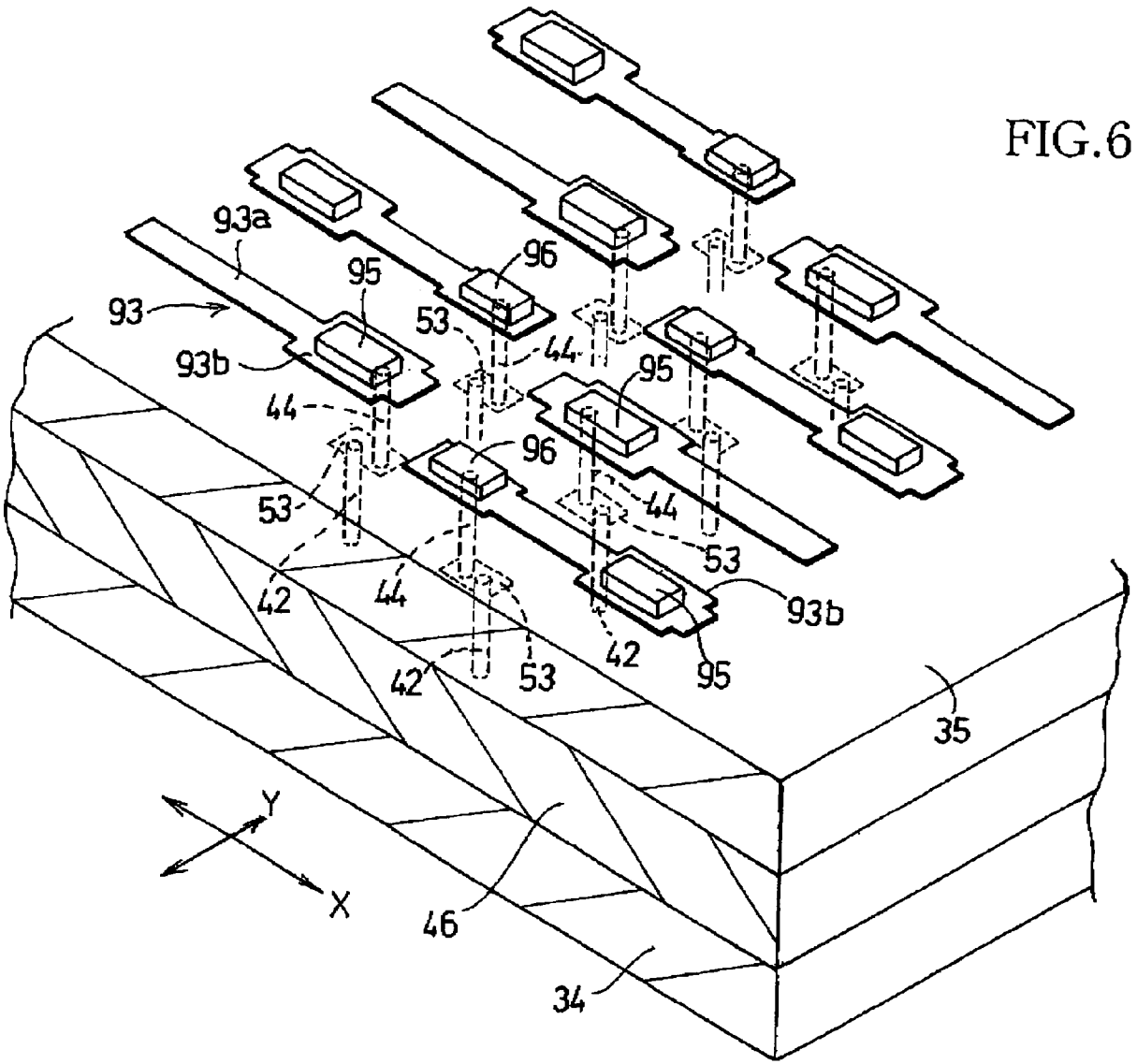
FIG. 6 is a perspective cutaway view showing an arrangement of connecting terminals on a surface of a top sheet and others.
Figure 7A:
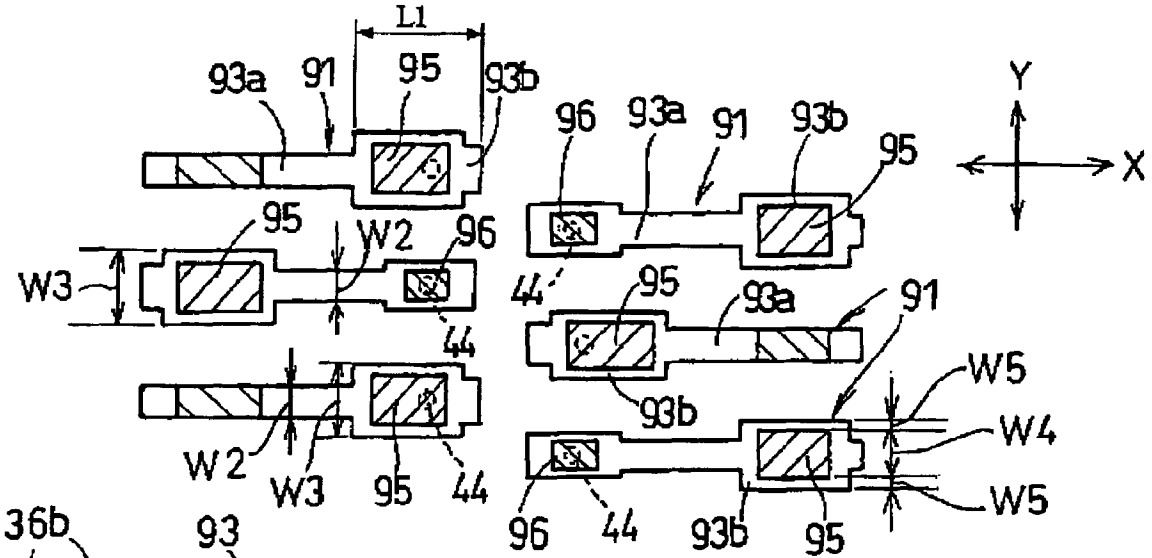
FIG. 7A is an enlarged plan view showing an arrangement related to connecting terminals for individual electrodes, including an arrangement of surface electrodes and external electrodes of the connecting terminals.
Figure 7B:
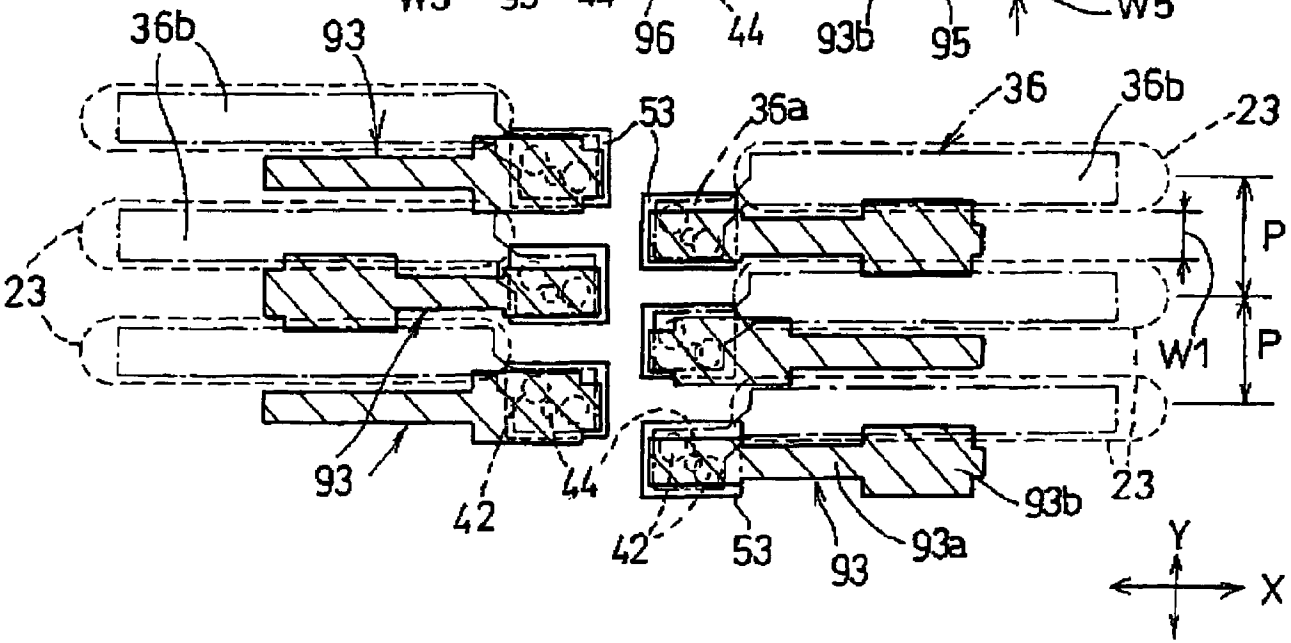
FIG. 7B is an enlarged plan view showing an arrangement of pressure chambers, individual electrodes, a pattern of linking electrodes, and connecting terminals for the individual electrodes.
Figures 8A, 8B:
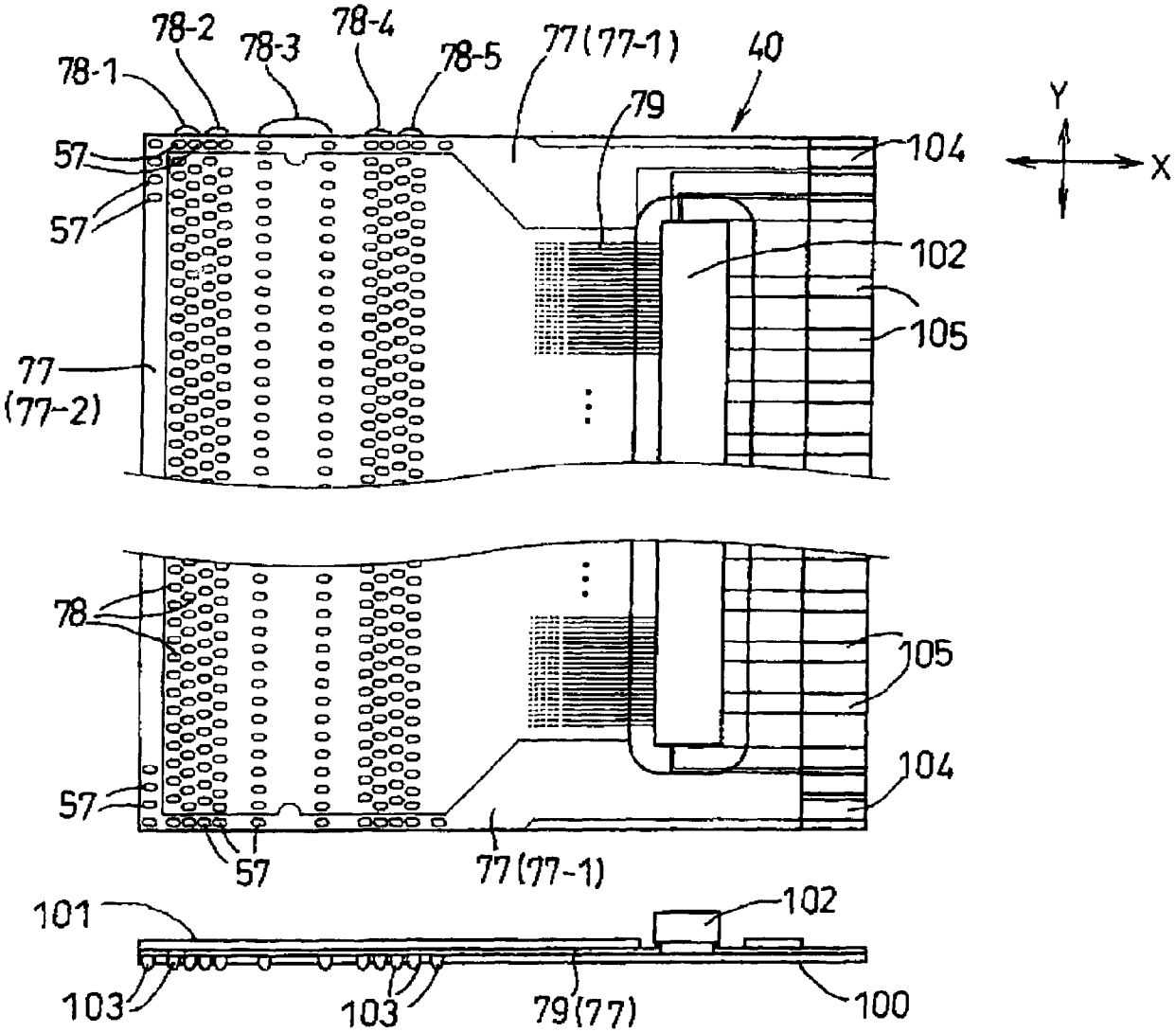
FIG. 8A is a schematic plan view showing an arrangement of openings at which bump electrodes for connection with common electrodes and with individual electrodes are respectively formed, a wiring, an integrated circuit, etc. on the flexible flat cable.
FIG. 8B is a side view corresponding to FIG. 8A.
Figure 9A:
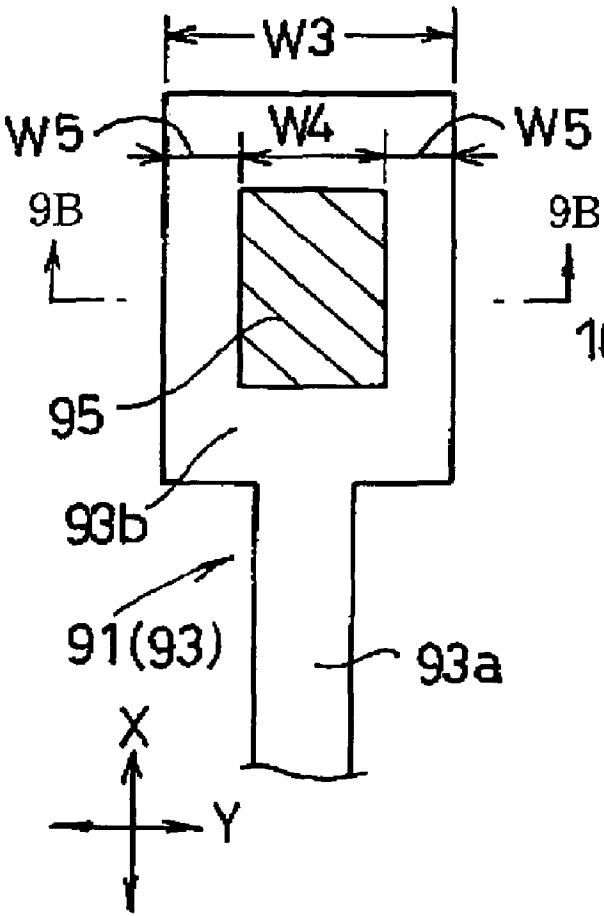
FIG. 9A is an enlarged plan view showing an arrangement of a surface electrode and an external electrode of a connecting terminal for an individual electrode.
Figure 9B:
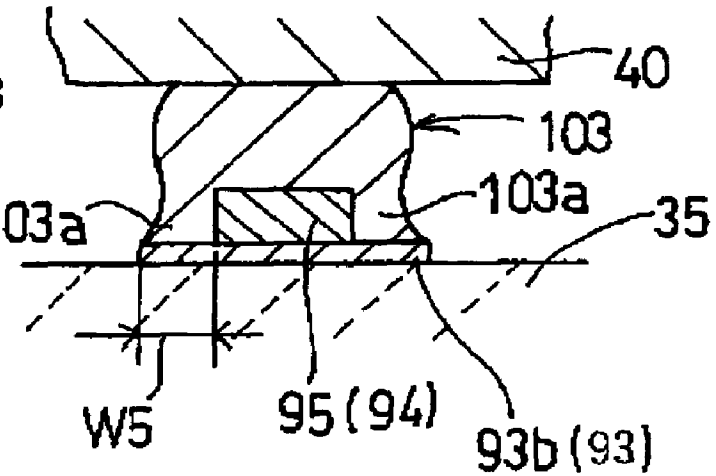
FIG. 9B is an enlarged cross-sectional view as taken along line 9B-9B in FIG. 9A, showing connection between the connecting terminal and the bump electrode.

FIG. 1 is a perspective view showing elements of an inkjet recording head for a recording apparatus, where the present invention is applied. FIG. 2 is a perspective view primarily showing a cavity unit. FIG. 3 is a perspective view showing in enlargement a part of the cavity unit. FIG. 4 is an exploded perspective view of a part of a piezoelectric actuator. FIG. 5 is a cross-sectional view showing a part of the piezoelectric actuator in enlargement. FIG. 6 is a perspective view showing an arrangement of connecting terminals and other elements on a top sheet of the actuator. FIG. 7A is a plan view showing a positional relationship between a surface electrode and an external electrode of each connecting terminal. FIG. 7B is a plan view showing a positional relationship among surface electrodes, external electrodes, pressure chambers, etc. FIG. 8A is a view showing an upper side of a flexible flat cable, while FIG. 8B is a side view of the flexible flat cable. FIG. 9A is an enlarged plan view showing a positional relationship between a surface electrode and an external electrode, while FIG. 9B is an enlarged cross-sectional view showing a portion connecting a bump electrode and a connecting terminal.

The inkjet recording head for color printing according to the invention includes a head unit 1 mounted on a carriage (not shown). The carriage is reciprocated in a direction parallel to a 'primary scan direction', which is perpendicular to a paper feeding direction or an "auxiliary scan direction". Hereinafter, the auxiliary scan direction will be referred to as a first direction or a Y-axis direction, and the primary scan direction as a second direction or an X-axis direction. On the head unit 1, ink cartridges containing inks of respective colors, for instance, cyan, magenta, yellow and black, are detachably mounted. Alternatively, such ink cartridges are statically disposed in a main body of the recording apparatus, and the color inks are supplied through a supply pipe and a damper chamber (that are not shown) mounted on the carriage.

The head unit 1, as shown in FIG. 2, comprises a cavity unit 10, a piezoelectric actuator 12, and a flexible flat cable 40. The cavity unit 10 has a plurality of nozzles 11*a* (see FIG. 2) that are aligned in plural rows each of which extends in the Y-axis or first direction and which are arranged in the X-axis direction with a suitable spacing, on a front surface (or an under surface as seen in FIG. 2). In this embodiment, five rows N1-N5 of nozzles 11*a* are provided, although N4, N5 are not shown. The piezoelectric actuator 12 is of multilayer plate-like type, and laminated on an upper surface of the cavity unit 10 by bonding with an adhesive or via an adhesive sheet. The flexible flat cable 40 is an example of a wiring board superposed on and bonded to a back or upper surface of the piezoelectric actuator for connecting the piezoelectric actuator with an external device.

The cavity unit 10 is constructed as shown in FIG. 2. That is, eight flat plates, namely, a nozzle plate 11, a cover plate 15, a damper plate 16, two manifold plates 17, 18, two spacer plates 19, 20, and a base plate 21 where pressure chambers 23 are formed, are superposed on one another in the order of the description, and bonded, to constitute a laminar structure. Except the nozzle plate 11 made of a synthetic resin, each plate 15-21 is made of a nickel alloy steel sheet containing 42% of nickel and has a thickness of 50 to 150 μm.

In the nozzle plate 11, the multiple nozzles 11*a* for ink ejection therethrough, each having a very small diameter (i.e., about 25 μm), are formed in the rows N1-N5 each of which extends in the first direction (i.e., in a longitudinal direction of the cavity unit 10 which is parallel to the auxiliary scan direction or the Y-axis direction shown in FIG. 2), and which are arranged in a staggered configuration. Each nozzle row N1-N5 has a length of one inch and consists of 75 nozzles 11*a*. Thus, the nozzles are arranged in a density of 75 dpi (dot per inch).

Reference numerals N1-N5 (although the rows N4 and N5 are not seen in FIG. 2) respectively denote the nozzle rows in an order from right to left. The nozzle rows N1-N3 are for ejecting the cyan ink (C), the yellow ink (Y), the magenta ink (M), respectively, while the nozzle rows N4 and N5 are for ejecting the black ink.

The upper and lower manifold plates 17, 18 are configured such that ink passages each elongate in the Y-axis direction are formed therethrough. The manifold plates 17, 18 are interposed between the first spacer plate 19 on the upper side and the damper plate 16 on the lower side, thereby making the ink passages five common ink chambers (or manifold chambers) 26. In FIG. 2, reference numerals 26*a*, 26*b*, 26*c*, 26*d*,

26*e* denote the respective common ink chambers in an order from right to left. The common ink chambers 26*a*, 26*b*, 26*c* are for the cyan ink (C), yellow ink (Y) and magenta ink (M), respectively, while the common ink chambers 26*d*, 26*e* (BK) are for the black ink.

In FIG. 2, reference numerals 31*a*, 31*b*, 31*c*, 31*d* respectively denote, in an order from right to left, four ink supply openings which are formed in one of opposite end portions of the base plate 21 in the Y-axis direction, with a suitable spacing in the X-axis direction. The ink supply openings 31*a*, 31*b*, 31*c* respectively correspond to the rightmost three 26*a*, 26*b*, 26*c* of the common ink chambers, while the ink supply opening 31*d*, which is the fourth as counted from right, commonly corresponds to adjacent end portions of the common ink chambers 26*d*, 26*e*. As shown in FIG. 2, four ink supply passages 32 are formed at one of opposite end portions of each of the first and second spacer plates 19, 20 to positionally correspond to the ink supply openings 31*a*, 31*b*, 31*c*, 31*d*, respectively, and communicated with the common ink chambers 26*a*, 26*b*, 26*c*, and 26*d* and 26*e*, respectively.

On an under surface of the damper plate 16 bonded to a back surface of the lower one 17 of the two manifold plates, there are formed recesses for forming damper chambers 27, each elongate in the Y-axis direction and open downward, at positions corresponding to the common ink chambers 26*a*-26*e*, respectively. With the damper plate 16 superposed on the cover plate 15, the recesses are closed by the cover plate 15 to form completely sealed damper chambers 27.

By this arrangement, a backward component of each of pressure waves acting on the pressure chambers 23 due to actuation of the piezoelectric actuator 12, is propagated through the ink, proceeds toward the corresponding common ink chamber 26, and is absorbed by vibration of the portions of the damper plate 16 where the thickness is relatively small. Thus occurrence of a crosstalk is prevented.

In the first spacer plate 19, restrictors 28 are formed to respectively positionally correspond to the nozzles 11*a* aligned in rows N1-N5. Each restrictor 28 has a shape of slit long in the X-axis direction, in other words, narrow in the Y-axis direction. One of opposite ends (or first end) of each restrictor 28 is communicated with a corresponding one of the common ink chambers 26*a*-26*e* formed in the manifold plate 18, while the other end (or second end) of each restrictor 28 is communicated with a corresponding one of communication holes 29 formed through the second spacer plate 20 located on the upper side of the first spacer plate 19, as shown in FIG. 3.

There are formed, through all of the cover plate 15, damper plate 16, two manifold plates 17, 18, and first and second spacer plates 19, 20, communication passages 25 that are in communication with the nozzles 1*a* aligned in rows N1-N5, at positions aligned with neither the common ink chambers 26 nor the damper chambers 27 in the vertical direction.

Through the base plate 21 are formed pressure chambers 23 arranged in rows, which will be respectively denoted by reference numerals 23-1, 23-2, 23-3, 23-4, 23-5. The rows 23-1 to 23-5 of the pressure chambers 23 correspond to the nozzle rows N1-N6, respectively, and each of the rows 23-1 to 23-5 consists of a number of the pressure chambers 23 corresponding to the number of the nozzles 11*a* aligned in a row. Each of the pressure chambers 23 is elongate in the X-direction, and one of opposite ends of each pressure chamber 23 in the longitudinal direction or the X-direction is in communication with the second end of a corresponding one of the restrictors 28 via the corresponding communication hole 29 formed through the second spacer plate 20, while the other end of each pressure chamber 23 is in communication with a corresponding one of the communication passages 25 formed through the second spacer plate 20. The pressure chambers 23 are arranged in rows extending along the Y-axis direction with a partition wan 24 between each adjacent two pressure chambers, The pressure chambers 23 are misaligned with respect to the pressure chambers 23 of the adjacent row(s), by a half of a pitch P at which the pressure chambers 23 are arranged in rows in the Y-axis direction, namely, the rows of the pressure chambers 23 are arranged in a staggered configuration.

According to the above-described arrangement, the ink flowed into the common ink passage 26*a*-26*e* from the ink supply opening 31*a*-31*d* is distributed to the corresponding pressure chambers 23 through the restrictors 28 and communication holes 29, and then flowed from the pressure chambers 23 to the nozzles 11*a* through the communication passages 26.

There will be now described a structure of the piezoelectric actuator 12. As will be described later, the piezoelectric actuator 12 has activation portions (energy generators) each of which is constituted by a part of a laminate formed by stacking piezoelectric sheets where individual electrodes 36 and common electrode 37 are formed alternately between the stacked piezoelectric sheets such that the individual electrodes 36 and the common electrodes 37 are opposed to each other in the vertical direction via the piezoelectric sheets. By applying voltage between a desired one of the individual electrodes 36 and the common electrode 37, a deflection in the stacking direction occurs at the activation portion corresponding to the individual electrode to which the voltage is applied, due to the piezoelectric longitudinal effect. The activation portions (energy generators) are formed in rows of the same number as the rows of the pressure chambers 23, with each row consisting of activation portions of the same number as each row of the pressure chambers 23, and at positions respectively corresponding to the pressure chambers 23.

More specifically, the activation portions are arranged in rows extending parallel to the rows of the nozzles 11*a* or pressure chambers 23 (i.e., in the first or Y-axis direction), and the number of the rows of the activation portions are the same as that of the nozzle rows, namely, five. The five rows of the activation portions are arranged in the second or X-axis direction. Each activation portion is formed in a shape elongate in the longitudinal direction of each pressure chamber 23, that is, in the second direction which is parallel to the width direction of the cavity unit 10, and the X-axis direction. The activation portions are arranged with a constant spacing, namely a pitch P, which is the same as that of the pressure chambers 23 as will be described later, and in a staggered configuration.

As shown in FIG. 4, the piezoelectric actuator 12 is constituted by a laminar structure including a group of piezoelectric sheets 33 and 34 which are stacked alternately, a constraining layer 46 constituted by a single sheet (which may be referred to as an "upper layer sheet" hereinafter) and superposed on an upper surface of the group of piezoelectric sheets 33, 34, and a top sheet 35 as a surface sheet superposed on an upper side of the upper layer sheet 46 as the constraining layer. The number of the piezoelectric sheets 33, 34 is seven and each of the sheets 83, 34 is made of a piezoelectric ceramic plate having a thickness of about 30 μm. The upper layer sheet 46 and the top sheet 35 may be formed of a piezoelectric ceramic plate, or any other insulative materials.

Elongate individual electrodes 36 are formed by screen printing on an upper surface (a larger face) of each even-numbered piezoelectric sheet 33 as counted from the lowermost piezoelectric sheet 34 having a common electrode 37 thereon, in a patterned fashion, namely, in rows extending in the first direction (i.e., in the longitudinal direction of the piezoelectric sheet 33, which is parallel to the Y-axis direction, and the direction in which the nozzle rows extend).

FIG. 4 shows only a part of each of the piezoelectric sheets 33. As shown in this figure, first through fifth rows of individual electrodes 36 (that are respectively denoted by reference numerals 36-1, 36-2, 36-3, 36-4, 36-5) are formed to positionally correspond to the above-described first through fifth rows of pressure chambers 23-1, 23-2, 23-3, 23-4, 23-5. Each of the individual electrodes 36 has a straight part 36*b* formed in a linear shape, which has a length substantially identical with that of each pressure chamber 23 as indicated by broken lines in FIG. 7B, and a width slightly smaller than that of each pressure chamber 23. Each straight part 36*b* overlaps a corresponding one of the pressure chambers 23 as seen from the upper side of the actuator 12.

One 36*a* of opposite end portions of each individual electrode 36 is bent with respect to the straight part 36*b* to extend to the outside of the pressure chamber 23 as seen from the upper side of the actuator 12, as shown in FIG. 7B. The end parts 36*a* of respective individual electrodes 36-3 of the third row are disposed on the outer side of the respectively corresponding pressure chambers 23, alternately on the opposite sides in the longitudinal direction of the individual electrodes 36-3.

As shown in FIGS. 4 and 7B, each end part 36*a* overlaps, as seen from the upper side of the actuator 12, with at least a part of a corresponding one of dummy individual electrodes 38 which are formed separately from one another in a configuration like islets in each of the piezoelectric sheets 34 located immediately over and under the piezoelectric sheet 33, and also with a corresponding one of linking electrodes 53 formed in the upper layer sheet 46 as will be described later. The end parts 36*a* are disposed at positions capable of being electrically connected to respectively corresponding internal conduction electrodes 42 formed through the piezoelectric sheets 33, 34 and the upper layer sheet 46, as shown in FIGS. 5 and 7B.

On the piezoelectric sheets 33, there are formed dummy common electrodes 43 at positions to respectively partially overlap with the common electrodes 37 on the piezoelectric sheets 34 as seen from the upper side. The positions of the dummy common electrodes 43 include margins, namely, both the shorter and longer sides, of one of a larger face of each piezoelectric sheet 33, as shown in FIG. 4.

The common electrodes 37 are formed by screen printing on an upper surface of each of odd-numbered piezoelectric sheets 34 as counted from the lowermost piezoelectric sheet 34, as shown in FIG. 4. The common electrode 37 formed on the lowermost piezoelectric sheet 34 is formed over an entire upper surface thereof. The common electrodes 37 formed on the other piezoelectric sheets 34 are formed to overlap with the rows 23-1, 23-2, 23-3, 23-4, 23-5 of the pressure chambers and accordingly with the rows 36-1, 36-2, 36-3, 36-4, 36-5 of the individual electrodes as seen from the upper side. Each common electrode 37 (except the one formed on the lowermost piezoelectric sheet 34) comprises a first electrically conductive part 37*a* consisting of a plurality of segments each extending in the Y-axis direction or parallel to the longer sides of the piezoelectric sheet 34, and a second electrically conductive part 37*b* consisting of two segments extending in the X-axis direction and along the respective shorter sides of the piezoelectric sheet 34. Opposite ends of each segment of the first electrically conductive part 37*a* are connected to the two segments of the second electrically conductive part 37*b*, respectively. Each common electrode 37 is formed to surround a part on the piezoelectric sheet 34 where the rows of the dummy individual electrodes 38 are formed.

The dummy individual electrodes 38, each of which has a generally rectangular shape as seen from the upper side, are disposed with a constant spacing so as to at least partially overlap with respectively corresponding end parts 36*a* of the individual electrodes 36, and not with the straight parts 36*b*, as seen from the upper side.

As shown in FIG. 4, on the upper layer sheet 46 as a constraining layer, the linking electrodes 53, each of which is generally rectangular as seen from the upper side, are disposed with a uniform spacing so that each linking electrode 53 overlaps at least a part of a corresponding one of the dummy individual electrodes 38 formed on the piezoelectric sheet 34, as seen from the upper side. At a portion of an upper surface of the upper layer sheet 46, including marginal portions along the shorter sides of the upper surface, there are formed in a patterned fashion communication electrodes 54 as conductive portions for common electrodes to overlap with a part of the common electrodes 37 on each piezoelectric sheet 34 and a part of the dummy common electrodes 43 on each piezoelectric sheet 33, as seen from the upper side.

Through each of the upper layer sheet 46 and the piezoelectric sheets 33, 34, except the lowermost piezoelectric sheet 34, internal conduction electrodes (not shown) are formed by filling each of a plurality of through-holes formed through the thickness of the sheet 46, 33, 34, at positions corresponding to the common and dummy common electrodes 37, 43, with an electrically conductive material or paste, so that the common electrodes 37 each consisting of the elongate segments 37*a*, 37*b*, and the dummy common electrodes 43 are electrically connected in a vertical direction at a plurality of places. Similarly, to electrically connect, in the vertical direction, the end parts 36*a* of the individual electrodes 36 on the piezoelectric sheets 33, the dummy individual electrodes 38 on the piezoelectric sheets 34, and the linking electrodes 53 on the upper layer sheet 46, internal conduction electrodes 42 are formed through each of the piezoelectric sheets 33, 34, and the upper layer sheet 46, by filing a plurality of through-holes formed through each sheet 33, 34, 46 with an electrically conductive material or paste. As shown in FIGS. 5 and 7B, the internal conduction electrodes 42 are formed at positions such that each internal conduction electrode 42 is spaced with a suitable distance from other internal conduction electrode(s) 42 which is/are formed through the sheet(s) 33, 34 immediately over/under the piezoelectric sheet, as seen from a side of the actuator 12.

As shown in FIGS. 4 through 7, on an upper surface of the top sheet 35 as a surface sheet or the uppermost layer of the piezoelectric actuator 12, connecting terminals (connecting electrodes) 90 for connection with the common electrodes as well as connecting terminals (connecting electrodes) 91 for connection with the individual electrodes are formed separately from one another in a configuration like islets. The two kinds of connecting terminals 90, 91 are to be connected to bump electrodes 103 for connection with the common electrodes and bump electrodes 103 for connection with the individual electrodes, respectively, that are formed on an under surface of the flexible flat cable 40.

Each of the connecting terminals 90 comprises a thin surface electrode 92 formed on the upper surface of the top sheet 35 and a thick external electrode 94 formed on the surface electrode 92. Similarly, each of the connecting terminals 91 comprises a thin surface electrode 93 formed on the upper surface of the top sheet 35 and a thick external electrode 95 formed on the surface electrode 93. To electrically connect, in the vertical direction, the connecting terminals 90 and the connecting terminals 91 on the top sheet 35 to the communication and linking electrodes 54, 53 on the upper layer sheet 46, internal conduction electrodes 44 are formed by filling a plurality of through-holes formed through the thickness of the top sheet 35 with an electrically conductive material or paste, in the same way as described above with respect to the internal conduction electrodes for the connection among the common electrodes 37 and the dummy common electrodes 43 and among the end parts 36*a*, dummy individual electrodes 38, and the linking electrodes 53.

The surface electrodes 92, 93 are formed using an electrically conductive Ag—Pd (silver-palladium)-based material or paste which is also used for forming the individual electrodes 36, common electrodes 37, dummy individual electrodes 38, dummy common electrodes 43, internal conduction electrodes 42, 44 filling the through-holes, linking electrodes 53, and communication electrodes 54. The Ag—Pd-based paste is screen-printed on green sheets to be formed into the piezoelectric sheets 33, 34 and the top sheet 35. Then theses sheets 33, 34, 35 are stacked in a predetermined order, and fired at a first temperature. Since the melting point of the Ag—Pd-based material is high, evaporation thereof does not occur even when the first temperature, at which the green sheets are fired, is high. However, the Ag—Pd-based material is not excellent in bonding characteristics with respect to a solder alloy.

The external electrodes 94, 95 are formed by screen-printing an electrically conductive material or paste containing silver and a glass frit suitable for forming electrodes of a relatively large thickness, on the surface electrodes 92, 93 as have been fired as described above, and then firing the structure of the stacked sheets at a second temperature lower than the first temperature. The electrically conductive material or the paste containing the silver and the glass frit is low in the melting point, but is excellent in bonding characteristics with respect to a solder alloy, compared to an Ag—Pd-based material. Therefore, according to the arrangement where the connecting terminals 90, 91 are such that the external electrodes 94, 96 are formed on the surface electrodes 92, 93, respectively, bonding characteristics of the connecting terminals 90, 91 with respect to the bump electrodes 103 as a whole improves, compared to an arrangement where such external electrodes 94, 95 are not provided.

The structure of the connecting terminals (connecting electrodes) 91 will be described in further details.

On the upper surface of the top sheet 35, there are disposed with a constant spacing the surface electrodes 93, each having a relatively small thickness, such that each surface electrode 93 overlaps with at least a part of a corresponding one of the linking electrodes 53 on the upper layer sheet 46. The longitudinal direction of the surface electrodes 93 are substantially parallel to the shorter sides of the top sheet 35, that is, parallel to the straight parts 36*b* of the individual electrodes 36, as shown in FIGS. 6, 7A and 7B. Namely, each surface electrode 93 is elongate in the second or X-axis direction. As shown in FIG. 7B, each surface electrode 93 is positioned over a corresponding one of the partition walls 24 which are arranged in rows on an under side of the surface electrodes 93 and each of which is defined between two adjacent pressure chambers 23. Thus the surface electrodes 93 are disposed at a pitch the same as the pitch P of arrangement of the pressure chambers 23 in the first direction, but rows of the surface electrodes 93 are misaligned with the respectively corresponding rows of the pressure chambers 23 by a half of the pitch P. A large part of each surface electrode 93 is constituted by a narrow part 93*a* having a width dimension W2 smaller than a width dimension W1 of the partition wall 24, thus W2<W1. A wide part 93*b* is formed continuously from the narrow part 93*a*. A width dimension W3 of the wide part 93*b* is determined to be slightly larger than that W1 of the partition wall 24. The pitch P of arrangement of the pressure chambers 23 in the first direction is about 339 μm, while the width W1 of the partition wall 24 is about between 120 to 160 μm, the width W2 of the narrow part 93*a* of the surface electrode 93 is about 100 μm, and the width W3 of the wide part 93*b* of the surface electrode 93 is about between 150 to 300 μm. Preferably, W3 is about 200 to 220 μM. A dimension L1 of the wide part 93*b* in its longitudinal direction or in the X-axis direction is about 360 μm. Further, a thickness of each surface electrode 93 is about 1 to 2 μm.

The size of the external electrode 95 adhering to the surface of each wide part 93*b* is smaller than that of the wide part 93*b*, as seen from the upper side, and margins on all sides of the external electrode 95 are positioned on an inner side of a periphery of the wide part 93*b*. It is desirable that a width dimension W4 of the external electrode 95 is approximately 150 to 200 μm, while a dimension W5 in the Y-axis direction between the margin of the external electrode 95 and the periphery of the wide part 93*b* on which the external electrode 95 is disposed, is approximately 25 μm, as shown in FIG. 9A. A thickness of the external electrode 95 is 20 μm.

Similarly, the surface electrode 92 of each of the connecting terminals 90 for connection with the common electrodes, has a relatively small thickness, and is disposed to overlap with at least a part of the corresponding communication electrode 54 on the upper layer sheet 46, as seen from the upper side. Each surface electrode 92 is formed in a ribbon-like shape at a marginal portion of the upper surface of the top sheet 35, as shown in FIG. 4. An external electrode 94 having a relatively large thickness is formed on each surface electrode 92 in a suitable shape, after the surface electrodes 92 have been formed.

According to the configuration of the connecting terminals 91 for individual electrodes and connecting terminals 90 for common electrodes in the present embodiment, the internal conduction electrodes 44 are formed through the top sheet 35 to be exposed to the outside in an upper surface of the actuator 12. Hence, by forming protective electrodes 96 that cover the respective exposed surfaces of the internal conduction electrodes 44, the surfaces where the internal conduction electrodes 44 and the surface electrodes 93 are connected are protected. The protective electrodes 96 are made of the same material as the external electrodes 94, 95, and formed to fill the through-holes where the internal conduction electrodes 44 are formed as well as to cover the exposed surfaces of the internal conduction electrodes 44.

As shown in FIGS. 6, 7A and 7B, the connecting terminals 91 is arranged in the Y-axis direction with the wide parts 93*b* of their surface electrodes 93 disposed alternately on the opposite sides in the X-axis direction. Hence, even when the connecting terminals 91 have the wide parts 93*b*, each two connecting terminals 91 adjacent in the Y-axis direction are spaced from each other by a sufficient distance, reducing the risk of occurrence of short-circuit therebetween.

All the internal conduction electrodes 44 of a same row are connected to one of opposite end portions, in the X-direction, of the respectively corresponding surface electrodes 93 of the connecting terminals 91, on a same side in the X-axis direction. Accordingly, a part of the internal conduction electrodes 44 are covered by respective external electrodes 95, which means that the relevant external electrodes 95 function as protective electrodes as well.

The protective electrode 96 and external electrodes 94, 95 may take any suitable shape as seen from the upper side, such as a rectangular, oblong, and elliptical shape.

With reference to FIGS. 8A and 8B, there will be described, as an example of a wiring board for electric connection with the multiple connecting terminals 90 and 91 for common and individual electrodes that are formed on the surface of the piezoelectric actuator 12, a structure of the flexible flat cable 40, including arrangement of a conductor section 77 in which openings at which bump electrodes 103 for connection with common electrodes are formed, openings 78 at which bump electrodes 103 for connection with individual electrodes are formed, and a fine wiring 79 for connecting these bump electrodes 103 to an external element.

The flexible flat cable 40 is superposed on the top sheet 35 to extend outwards in a direction substantially perpendicular to the direction in which each nozzle row extend, that is, the flexible flat cable 40 extends in a direction substantially parallel to the X-axis direction, as shown in FIG. 1. The flexible flat cable 40 is electrically insulative and formed such that the conductor section 77 and the fine wiring 79 are formed of copper foil by photoresist or other methods, on a surface of a band-shaped base material 100 made of a flexible synthetic resin (e.g., polyimide, polyester, and polyamide). In the conductor section 77, there are formed through-holes or openings 57 which are formed through the base material 100 and at which the bump electrodes 103, which are to be connected to the connecting terminals 90 for common electrodes, are formed on the underside of the flexible flat cable 40. The wiring 79 are to be connected to the connecting terminals 91 for individual electrodes, via through-holes or openings 78 formed through the base material 100, and the bump electrodes 103 formed on the underside of the base material or flexible flat cable 40, at the openings 78. The surface of the base material 100 on which the copper foil is formed is covered by a cover layer 101 made of an insulative and flexible synthetic resin (e.g., polyimide, polyester, and polyamide). The other end of the wiring 79 is electrically connected to an integrated circuit 102 mounted on the base material 100. A plurality of terminals 105 are formed at the other end of the flexible flat cable 40 in its longitudinal direction, and the integrated circuit 102 is connected to the terminals 105. The openings 78 for individual electrodes are formed at positions to be respectively opposed to the external electrodes 95 of the connecting terminals 91 on the top sheet 35, and the bump electrodes 103 of a solder alloy are fixed at the openings 78, as shown in FIG. 8B. Similarly, where the conductor section 77 for common electrodes, which consists of segments 77-1 and 77-2 each of which is generally ribbon-like shaped as will be described below, is formed, the openings 57 are formed at positions to be opposed to the external electrodes 94 of the connecting terminals 90 on the top sheet 35, and bump electrodes 103 are fixed at the openings 57.

As shown in FIG. 8A, in the flexible flat cable 40, the conductor section 77 for common electrodes comprises at least a pair of first segments 77-1 which are formed in ribbon-like shape along two lateral edges of the flexible flat cable 40 which extend substantially in the second or X-axis direction, i.e., in the direction substantially parallel to the shorter sides of the actuator 12. In this specific example, the conductor section 77 further comprises a single second segment 77-2 which is also ribbon-like shaped and extends along an edge of the flat cable 40 extending substantially in the first or Y-axis direction (i.e., substantially along the longitudinal direction of the actuator 12), and opposite ends of the second segment 77-2 are respectively electrically connected to an end of each of the first segments 77-1. The other end of each first segment 77-1 is electrically connected to a corresponding one of connecting terminals 104 that are disposed at the other end of the flexible flat cable 40 in its longitudinal direction, namely, the end of the cable 40 opposite to the side to be connected to the actuator 12.

On the other hand, the openings 78 for individual electrodes are arranged in rows extending in the first or Y-axis direction and disposed in a staggered configuration, to positionally correspond to the first through fifth rows of the pressure chambers 23-1, 23-2, 23-3, 23-4, 23-5 and accordingly the external electrodes 95 aligning therewith. In FIG. 8A, reference numeral 78-1 denotes a first group of openings 78 for individual electrodes which corresponds to the first row 23-1 of pressure chambers, while 78-2 denotes a second group of openings 78 which corresponds to the second row 23-2 of pressure chambers, and reference numerals 78-3, 78-4, and 78-5 respectively denote a third, fourth and fifth groups of openings 78 that respectively correspond to the third, fourth, and fifth rows 23-3, 23-4, 23-5 of pressure chambers.

The wiring 79 connected to all the rows 78-1 to 78-5 of the openings 78 is formed to extend substantially in the second or X-axis direction.

The integrated circuit 102 for driving the actuator 12 converts recording data which is serially transmitted from an external device, e.g., a control circuit board in the main body of the recording apparatus, into parallel data corresponding to the respective nozzles, generates waveform signals of a predetermined voltage that correspond to the recording data, and outputs the waveform signals to the wiring 79. The connection between the integrated circuit 102 and the actuator 12 requires that the wiring 79 be formed with high density, correspondingly to the large number of nozzles, while the wiring between the integrated circuit 102 and the control circuit board is not required to be that highly dense, since the recording data is serially transmitted there.

When a solder alloy is employed for forming the bump electrodes 103, the bump electrodes 103 are bonded to the external electrodes 94 of the connecting terminals 90 for common electrodes and the external electrodes 95 of the connecting terminals 91 for individual electrodes, by pressing with heat application after the bump electrodes 103 are set on the external electrodes 94, 95. As shown in FIG. 9B, the molten solder alloy of the bump electrodes 103 covers the upper and side faces of the external electrodes 95, and even a surface of the wide part 93*b* of each surface electrode 93, over a portion close to the extreme edges of the wide part 93*b*. The surface of the wide part 93*b* of the surface electrode 93 made of the electrically conductive Ag—Pd-based material is excellent in wettability with the molten solder alloy, while the external electrode 95 made of the material containing silver and the glass frit shows an excellent bonding strength with the solder alloy, due to the eutectic bonding therebetween. Even when the volume of the solder alloy is excessive and the solder alloy flows out of the wide part 93*b*, the flow proceeds to the narrow part 93*a* and solidifies there. Thus the risk of short-circuit between two adjacent surface electrodes 93 is low.

By having the dimension W5 between the margin of the external electrode 95 and the periphery of the wide part 93*b* on the corresponding side relatively large, a thickness of a fillet 103*a* formed between the margin of the external electrode 95 and the surface of the wide part 93*b*, as shown in FIG. 9B, is made relatively large. When the recording head is repeatedly used under conditions where the variation or change in the temperature of the flexible flat cable is relatively large and the flexible flat cable 40 thus greatly expands and contracts, the spacing between each adjacent two of the bump electrodes 103 increases and decreases and great stress concentration occurs at the fillet 103*a* beside the external electrode 95 as connected to the bump electrode 103. According to the present embodiment, since the thickness of the fillet 103*a* is relatively large, it is possible to have a radius of a cross-sectional surface of the fillet 105*a* relatively large. With the large radius of the cross-sectional surface of the fillet 103*a*, the stress concentration factor or shape factor in terms of the strength of materials is decreased, alleviating the adverse influence of the stress concentration. With thus improved robustness, the fillet 108*a* does not suffer from cracking even when subjected to a thermal shock or repeated stress (fatigue), and therefore electric disconnection does not occur.

The degree of the stress concentration is great when the flexible flat cable 40 contracts in its width direction (i.e., in the first or Y-axis direction). To resist this great stress concentration, the thickness of the fillet 103*a* formed between the margin of the external electrode 95, which extends in the X-axis direction perpendicular to the Y-axis direction, and the surface of the wide part 93*b* beside the margin, needs to be increased. To meet this requirement, the width dimension W4 of the external electrode 95 is made smaller than a dimension of the external electrode 95 in the X-axis direction, and is desirably reduced in the maximum degree possible with respect to the width dimension W3 of the wide part 93*b* in the Y-axis direction, so that the width dimension W5 of a portion of the surface of the wide part 93*b*, which is a base area on which the fillet 103*a* is to be formed, is maximized. In addition, since in the present embodiment the connecting terminals 91 are arranged such that the number thereof is large in the first or Y-axis direction, in which the expansion/contraction of the flexible flat cable 40 is great, the number of the formed fillets 103*a* as counted in the first direction is also large, compared to the second or X-axis direction. This arrangement is effective to prevent the separation of the bump electrodes 103 from the connecting terminals 91 upon expansion/contraction of the flexible flat cable. Further, since fillets are also formed on both of the opposite ends of each wide part 93*b* in the second or X-axis direction there can be obtained an effect of preventing separation of the bump electrodes 103 from the connecting terminals 91 with respect to expansion/contraction of the flexible flat cable 40 in the X-axis direction, also.

The arrangement where the connecting terminals 91 for individual electrodes, or the surface electrodes 93 and external electrodes 95, are respectively disposed over the portions between two adjacent pressure chambers 23 of the cavity unit 10, namely, above the partition walls 24, is advantageous in that when the bump electrodes 103 on the flexible flat cable 40 are opposed to and pressed onto the external electrodes 95, the partition walls 24 receive the pressing force, preventing deformation of the hollow pressure chambers 23.

In the above-described embodiment, the integrated circuit 102 for driving the actuator 12 is mounted on an intermediate part of the flexible flat cable 40 in the longitudinal or extending direction of the cable 40 and the end of the wiring 79 is connected to the integrated circuit 102. Thus the structure for connecting the control circuit board in the main body of the recording apparatus with the actuator is simplified, compared to an arrangement where the integrated circuit is disposed at another place, facilitating a work operation for connecting the flexible flat cable to the actuator via the bump electrodes, while improving the bonding strength therebetween.

In the above-described embodiment, five nozzle rows are provided, and accordingly ten rows of the openings 78 or the bump electrodes 103 to be connected to the connecting terminals 91 for individual electrodes, are disposed in a staggered configuration. However, the principle of the invention is applicable in any cases where three or more rows of openings 78 or bump electrodes 103 to be connected to the connecting terminals 91 are provided.

What is claimed is:

1. A connection structure for connecting an inkjet recording head which includes an actuator on which a plurality of connecting terminals to apply therethrough a drive voltage to each of a plurality of channels formed in the inkjet recording head for ejection of an ink droplet onto a recording medium, to a circuit element through which control signals for controlling an operation of the inkjet recording head are supplied, the circuit element being disposed on a wiring board having a plurality of bump electrodes formed thereon, and the connecting terminals being superposed on and connected to the bump electrodes, the connection structure comprising:

each of the connecting terminals comprising a surface electrode and an external electrode which is formed directly on the surface electrode and which has a thickness larger than a thickness of the surface electrode;

the surface electrode and the external electrode of each of the connecting terminals are both bonded to a corresponding one of the bump electrodes; and at least a part of the surface electrode having a width larger than the other part thereof to constitute a wide part of the surface electrode, and the external electrode being disposed such that a margin of the external electrode is positioned on an inner side of a periphery of the wide part.

2. The connection structure of claim 1, wherein the inkjet recording head includes an actuator comprising a plurality of rows of nozzles each of which consists of a plurality of nozzles and extends in a first direction, a plurality of rows of pressure chambers which correspond to the respective nozzles, and a plurality of energy generators for selectively applying ejection energy on ink in the respective pressure chambers, wherein the wiring board is a flexible flat cable having a flexibility, and wherein the surface electrodes formed on the actuator comprises a plurality of individual surface electrodes which are individually connected to the respective energy generators and arranged in rows corresponding to the rows of the nozzles, and a common surface electrode which is commonly connected to the energy generators.

3. The connection structure of claim 2, wherein a dimension of the external electrode in the first direction is smaller than a dimension of the external electrode in a second direction perpendicular to the first direction.

4. The connection structure of claim 3, wherein the individual surface electrodes are arranged in rows each of which extends in the first direction, and wherein the wide part of each individual surface electrode is formed at one of opposite ends of the individual surface electrode in the second direction, and the wide parts of the individual surface electrodes of a same row are formed alternately on the opposite sides in the second direction.

5. The connection structure of claim 2, wherein the flexible flat cable extends substantially in a second direction perpendicular to the rows of the nozzles, wherein each of the pressure chambers is elongate in the second direction, wherein each of the individual surface electrodes is elongate in the second direction, and disposed to positionally correspond to a corresponding one of portions that are respectively defined between two of the nozzles adjacent in the first direction, and wherein each of the external electrodes is formed at a portion of each of the individual surface electrodes.

6. The connection structure of claim 5, wherein an integrated circuit as a circuit element for driving the energy generators is disposed in an intermediate part of the flexible flat cable in the second direction, and the bump electrodes are connected to the integrated circuit via a wiring formed on the flexible flat cable.

7. The connection structure of claim 2, wherein each of the external electrodes is disposed on each of the individual surface electrodes such that margins of the external electrode on two opposite sides in a second direction perpendicular to the first direction are positioned on the inner side of the periphery of the wide part.

8. The connection structure of claim 2, wherein each of the external electrodes is disposed on each of the individual surface electrodes such that margins of the external electrode on two opposite sides in the first direction are positioned on the inner side of the periphery of the wide part.

* * * * *